US007148439B2

(12) United States Patent
Nashiki et al.

(10) Patent No.: US 7,148,439 B2
(45) Date of Patent: Dec. 12, 2006

(54) HIGH DURABILITY TOUCH PANEL

(75) Inventors: Tomotake Nashiki, Osaka (JP); Hideo Sugawara, Osaka (JP); Hidetoshi Yoshitake, Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 11/139,790

(22) Filed: May 31, 2005

(65) Prior Publication Data

US 2005/0274596 A1 Dec. 15, 2005

(30) Foreign Application Priority Data

Jun. 1, 2004 (JP) ..... P.2004-162724
Mar. 23, 2005 (JP) ..... P.2005-083642

(51) Int. Cl.
*H01H 1/00* (2006.01)

(52) U.S. Cl. ..... 200/512

(58) Field of Classification Search ..... 200/512–517, 200/5 R, 85 A, 85 R, 86 R, 308–317, 511, 200/61.43

See application file for complete search history.

(56) References Cited

U.S. PATENT DOCUMENTS 4,017,697 A * 4/1977 Larson ..... 200/5 A
4,243,861 A * 1/1981 Strandwitz ..... 200/512
6,054,664 A * 4/2000 Ariga et al. ..... 200/512
6,392,178 B1 * 5/2002 Kuratani ..... 200/512
6,603,085 B1 * 8/2003 Oya et al. ..... 200/512
6,639,163 B1 * 10/2003 Fukui et al. ..... 200/512
6,831,241 B1 * 12/2004 Fukui et al. ..... 200/512

FOREIGN PATENT DOCUMENTS

JP 02-066809 3/1990
JP 2002-326301 11/2002

* cited by examiner

*Primary Examiner*—Elvin Enad
*Assistant Examiner*—M. Fishman
(74) *Attorney, Agent, or Firm*—Westerman, Hattori, Daniels & Adrian, LLP.

(57) ABSTRACT

The present invention provides a touch panel having: a first panel board having a first base layer and a first conductive thin film disposed on one side of the first base layer; and a second panel board having a second base layer and a second conductive thin film disposed on one side of the second base layer; wherein the first panel board and the second panel board are arranged thorough a spacer so that the first conductive thin film and the second conductive thin film face each other, wherein the distance between the first conductive thin film and the second conductive thin film is from 20 to 100 μm, wherein the touch panel has a pushing angle of 3.9° or less at a point distant from an electrode provided at an end portion of the first panel board by 1.5 mm.

4 Claims, 4 Drawing Sheets

HIGH DURABILITY TOUCH PANEL

FIELD OF THE INVENTION

The present invention relates to a touch panel constituted by arranging a pair of upper and lower panel boards, which have conductive thin films, to be opposed to each other via a spacer such that the conductive thin films are opposed to each other, at least the upper panel board on a pen input side of both the panel boards having a plastic film as a base layer, and an image display using the touch panel.

BACKGROUND OF THE INVENTION

Thin films transparent for a light in the visible light region and having electric conductivity are generally used in display systems, e.g., a liquid crystal display and an electroluminescence display, transparent electrodes, e.g., a touch panel, and for the static prevention and cutoff of electromagnetic waves of transparent articles.

As such a transparent conductive thin film, so-called conductive glass comprising a glass plate having formed thereon an indium oxide thin film is conventionally used. However, since glass is used as a base, the conductive glass is inferior in flexibility and processability and cannot be used in some cases according to uses.

Therefore, in recent years, conductive thin films using various kinds of plastic films including polyethylene terephthalate as the base are used for various advantages, e.g., flexibility, processability, impact resistance and light weight. However, since the transparent conductive thin films having plastic films as base layers have a large light reflectivity on thin film surfaces, the transparent conductive think films have a problem of inferior transparency. In addition, there are problems in that the transparent conductive thin films are inferior in durability such as frictioning resistance and flex resistance of the conductive thin films and are damaged during use to cause an increase in electrical resistance or cause disconnection.

In particular, in a touch panel constituted by arranging a pair of upper and lower panel boards, which have conductive thin films, to be opposed to each other via a spacer such that the conductive thin films are opposed to each other, the conductive thin films are brought into contact with each other strongly by pen input from the upper panel board side. Thus, it is desired that the touch panel has satisfactory durability resistible against the contact, that is, durability against pen input.

However, when a panel board having a plastic film as a base layer is used for at least the upper panel board on the pen input side of both the panel boards, there are problems in that, because of insufficient flex resistance or the like of the conductive thin film, the touch panel is inferior in durability against pen input and a durable life as the touch panel is reduced.

To cope with the problems, the applicant has proposed a transparent conductive laminate in which a conductive thin film is formed on one surface of a plastic base layer with thickness of 2 to 120 μm and another plastic base layer is stuck to the other surface via an adhesive layer (see reference 1). This transparent conductive laminate is excellent in durability such as flex resistance. Thus, by using this transparent conductive laminate in at least an upper panel board on a pen input side of a touch panel, it is possible to improve durability against pen input and extend a durable life of the touch panel.

Incidentally, in recent years, since a rim of a touch panel is narrowed in design of the touch panel, there is a strong desire for durability against pen input in the vicinity of electrodes provided at ends of panel boards. In addition, in a touch panel started to be used, as design of a touch panel, not only an upper panel board on a pen input side but also a lower panel board opposed to the upper panel board is made of a plastic base layer and the lower panel board is stuck on a glass board of a display device such as a liquid crystal cell.

Under such circumstances, the proposed transparent conductive laminate cannot sufficiently cope with durability against pen input in the vicinity of the electrodes provided at the ends of the panel boards. The touch panel of the type, in which the lower panel board is also made of the plastic base layer, is particularly inferior in durability against pen input in the vicinity of the electrodes provided at the ends of the panel boards.

[Reference 1] JP 2002-326301 A

In view of such circumstances, the invention relates to a touch panel using a panel board having a base layer comprising a plastic film. It is an object of the invention to improve durability against pen input in the vicinity of electrodes provided at ends of the panel boards (hereinafter referred to as "end push pen input durability").

SUMMARY OF THE INVENTION

The present inventors have made eager investigation to solve the problem. As a result, the inventors have found that it is possible to improve durability against an end push input pen if, in a touch panel using at least one panel board having a base layer comprising a plastic film, a gap between upper and lower panel boards is reduced to set a distance between conductive thin films in a specific range in which a Newton's ring does not occur, and a pushing angle at a point distant from an electrode provided at an end portion of the panel board by 1.5 mm is set at equal to or smaller than a predetermined value.

In addition, it has been found that, in a touch panel using a plastic base layer for an upper panel board and a lower panel board, it is possible to improve durability against an end push input pen if, in addition to reducing the gap, thickness of an adhesive layer for sticking the lower panel board to a glass board of a display device is reduced to set the thickness in a specific range in which an adhesive force is not hindered, and a pushing angle at a point distant from an electrode provided at an end portion of the panel board by 1.5 mm is set at equal to or smaller than a predetermined value.

Moreover, in addition to the means described above, it has been found that it is possible to further improve durability against an end push input pen by using a transparent conductive laminate in which a conductive thin film is formed on one surface of a plastic base layer with thickness of 2 to 120 μm as an upper panel board on a pen input side and another plastic base layer is stuck to the other surface via an adhesive layer.

The present invention is mainly directed to the following items:

1. A touch panel comprising: a first panel board having a first base layer and a first conductive thin film disposed on one side of the first base layer; and a second panel board having a second base layer and a second conductive thin film disposed on one side of the second base layer; wherein the first panel board and the second panel board are arranged thorough a spacer so that the first conductive thin film and the second conductive thin film face each other, wherein the distance between the first conductive thin film and the second conductive thin film is from 20 to 100 μm, wherein the touch panel has a pushing angle of 3.9° or less at a point distant from an electrode provided at an end portion of the first panel board by 1.5 mm.

2. The touch panel according to item 1, wherein the first base layer comprises a plastic film, and the second base layer comprises a glass layer.

3. The touch panel according to item 1, which further comprises a first adhesive layer having a thickness of from 2 to 30 μm so that the second panel board is disposed on a glass plate of an image display device through the first adhesive layer, wherein the first base layer comprises a plastic film, and the second base layer comprises a plastic film.

4. The touch panel according to item 1, which further comprises: a second adhesive layer; and a third base layer comprising a plastic film, wherein the first base layer has a thickness of from 2 to 120 μm, wherein the third base layer is disposed on the other side of the first base layer, which is opposite to the side on which the first conductive thin film is disposed, through the second adhesive layer.

5. An image display device comprising: a display device; and a touch panel according to item 1 disposed on a visual side of the display device.

In the present invention, a pushing angle at a point distant from an electrode provided at an end portion of the first panel board by 1.5 mm means, as shown in FIG. 4, an angle θ defined between the lower surface of an upper panel board P1 and the upper surface of a lower panel board P2 at the time when an input pen is pressed against the lower panel board from the upper panel board side at a point distant from the electrode by 1.5 mm.

DETAILED DESCRIPTION OF THE INVENTION

An embodiment of the invention will be hereinafter explained with reference to the drawings.

Figure 1:
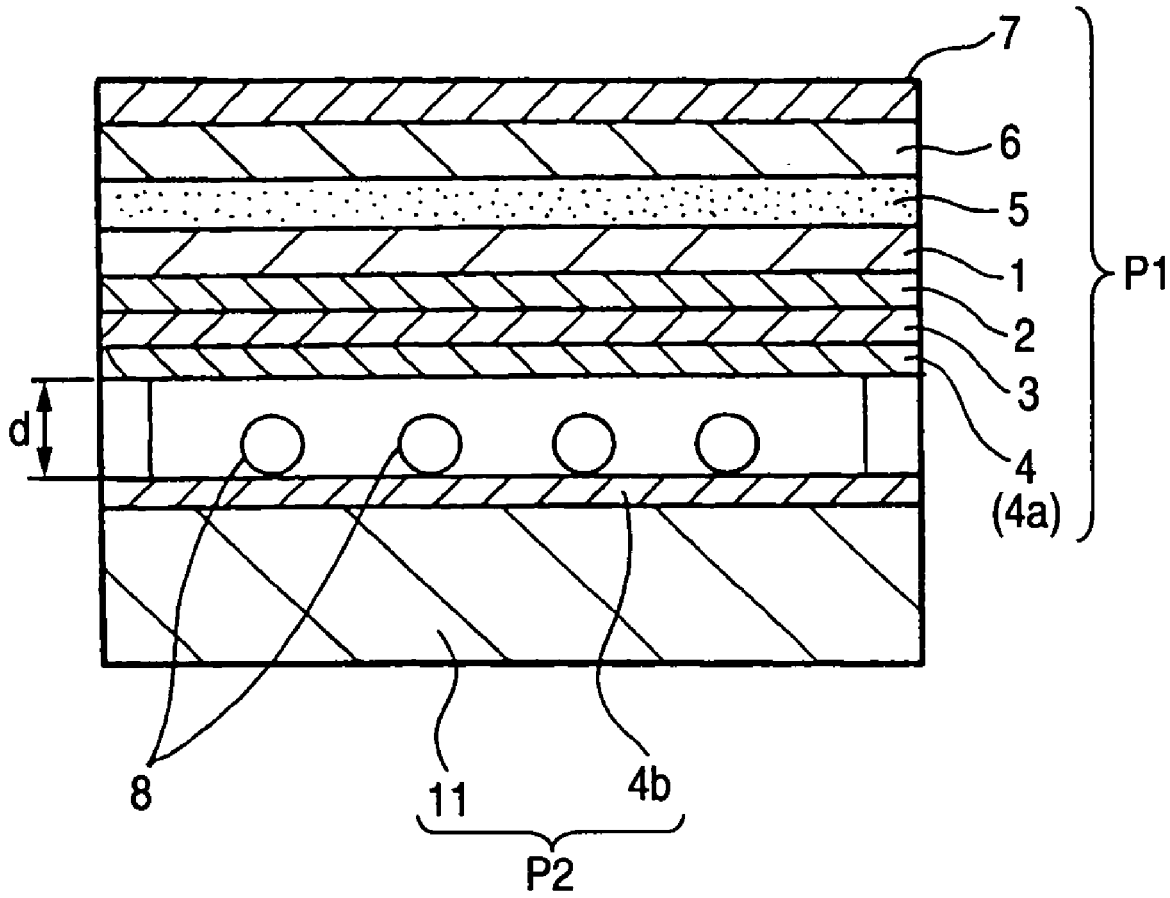
FIG. 1 is a sectional view showing an example of a touch panel of the invention.

FIG. 1 shows an example of a touch panel in which an upper panel board on a pen input side has a plastic film as a base layer and a lower panel board has glass as a base layer.

In FIG. 1, P1 is the upper panel board on the pen input side having a plastic film as a base layer and P2 is the lower panel board having glass as a base layer.

In the upper panel board P1, a transparent conductive thin film 4 (4*a*) is formed on one surface of a transparent base layer 1 made of a plastic film via a transparent first dielectric thin film 2 and a transparent second dielectric thin film 3. A transparent base layer 6 made of another plastic film is stuck to the other surface via a transparent adhesive layer 5. A hard coat treated layer 7 is formed on an uppermost surface on the pen input side of the base layer 6.

In the lower panel board P2, a transparent conductive thin film 4*b* is formed on one surface of a transparent substrate 11 made of a glass board. The lower panel board P2 and the upper panel board P1 are arranged to be opposed to each other via a spacer 8 such that the conductive thin films 4*a* and 4*b* are opposed to each other.

In the touch panel constituted as described above, a gap between the upper panel board P1 and the lower panel board P2 is reduced, a distance d between the conductive thin films 4*a* and 4*b* is set to 20 to 100 μm, preferably 30 to 70 μm such that a pushing angle at a point distant from an electrode provided at an end portion of the panel board by 1.5 mm is of 3.9° or less.

Consequently, since durability against an end push input pen is improved, it is possible to cope with a narrowed rim end of the touch panel. When the distance d between the conductive thin films 4*a* and 4*b* is less than 20 μm, a Newton's ring, which is one of an evaluation factor of the touch panel, tends to occur.

Figure 2:
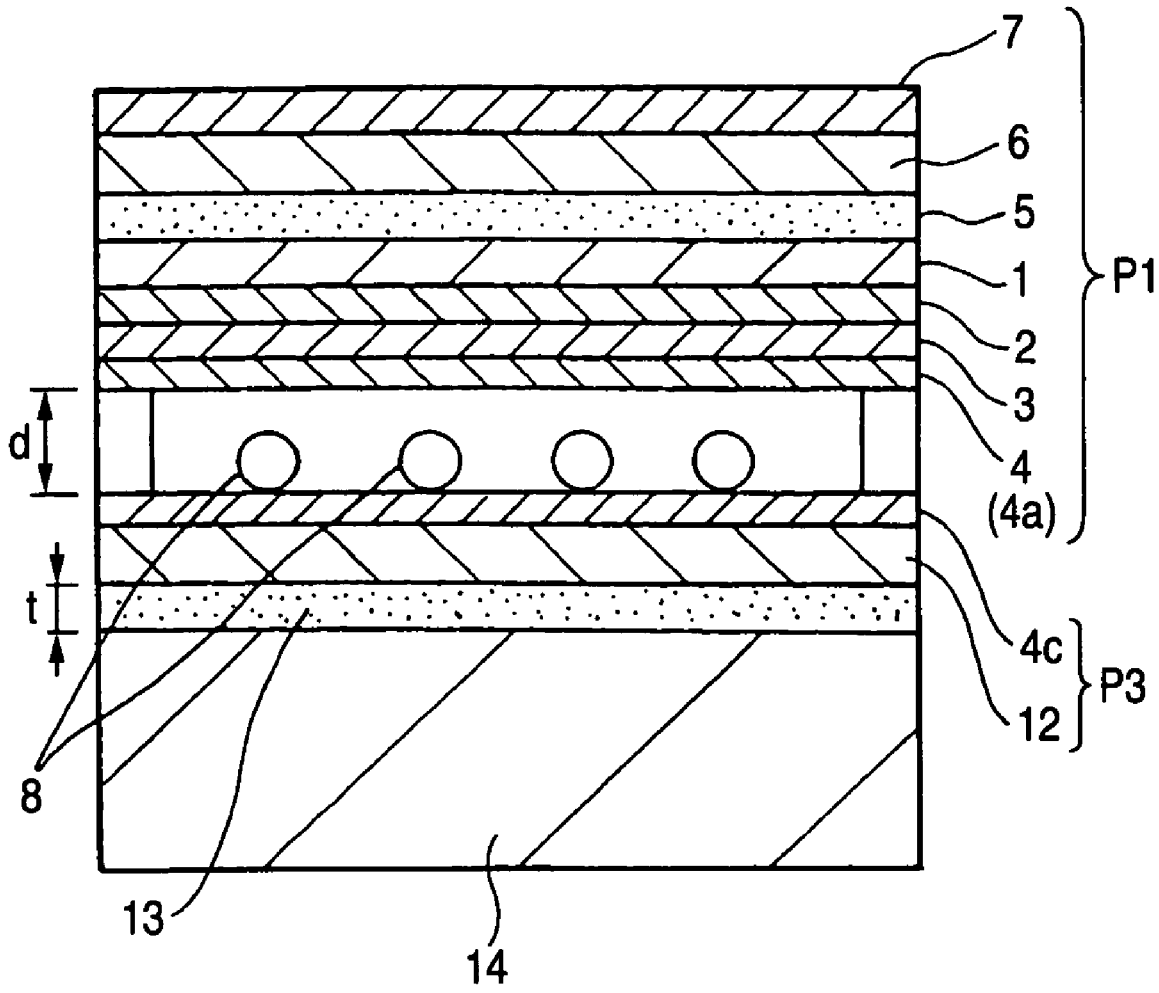
FIG. 2 is a sectional view showing another example of the touch panel of the invention.

FIG. 2 shows an example of a touch panel in which both an upper panel board and a lower panel board on a pen input side have plastic films as base layer and the lower panel board is stuck to a glass board of a display device via an adhesive layer.

In the upper panel board P1, as in FIG. 1, the transparent conductive film 4 (4*a*) is formed on one surface of the transparent base layer 1 made of a plastic film via the transparent first dielectric thin film 2 and the transparent second dielectric thin film 3. The transparent base layer 6 made of another plastic film is stuck to the other surface via the transparent adhesive layer 5. The hard coat treated layer 7 is formed on an uppermost surface on the pen input side of the base layer 6.

In a lower panel board P3, a transparent conductive thin film 4*c* is formed on one surface of a transparent base layer 12 made of a plastic film. The lower panel board P3 and the upper panel board P1 are arranged to be opposed to each other via the spacer 8 such that the conductive thin films 4*a* and 4*c* are opposed to each other. Moreover, the lower panel board P3 is stuck onto a glass board 14 of a display device such as a liquid crystal cell via a transparent adhesive layer 13.

In the touch panel constituted as described above, a gap between the upper panel board P1 and the lower panel board P3 is reduced, a distance d between the conductive thin films 4*a* and 4*c* is set to 20 to 100 μm, preferably 30 to 70 μm, and thickness t of an adhesive layer for sticking the base layer 12 onto the glass board 14 is set to 2 to 30 μm, preferably 2 to 20 μm such that a pushing angle at a point distant from an electrode provided at an end portion of the panel board by 1.5 mm is of 3.9° or less.

Consequently, since durability against an end push input pen is improved, it is possible to cope with a narrowed rim end of the touch panel. When the distance d between the conductive thin films 4*a* and 4*c* is less than 20 μm, a Newton's ring, which is one of an evaluation factor of the touch panel, tends to occur. When the thickness t of the adhesive layer 13 is less than 2 μm, it is difficult to secure a sticking property to the glass board 14 sufficiently.

In FIGS. 1 and 2, the upper panel board P1 may have the same structure as the lower panel board P3 shown in FIG. 2, that is, a transparent conductive thin film is simply formed on one surface of a transparent base layer made of a plastic film. However, in order to further improve durability against an end push input pen, the upper panel board P1 desirably has the structure shown in the figures.

In the structure shown in the figure, a material of the transparent base layer 1 is not specifically limited. For example, plastic films made of, for example, polyester resin, acetate resin, polyether sulfone resin, polycarbonate resin, polyamide resin, polyimide resin, polyolefin resin, polyvinyl chloride resin, polystyrene resin, polyvinyl alcohol resin, polyallylate resin, polyphenylene-sulfide resin, polyvinylidene chloride resin, or (metha-)acrylic resin are used. Among these plastic films, those made of polyester resin, polycarbonate resin, and polyolefin resin are preferable.

Thickness of the transparent base layer 1 made of such a plastic film is required to be in a range of 2 to 120 μm, preferably in a range of 6 to 100 μm. When the thickness is less than 2 μm, since mechanical strength as a base layer is insufficient, an operation for forming this base layer in a roll shape to form a dielectric thin film, a conductive thin film, and an adhesive layer continuously is difficult. When the thickness exceeds 120 μm, it is difficult to improve durability such as frictioning resistance and flex resistance of the conductive thin film 4 based on a cushion effect of the adhesive layer 5 described later.

The transparent base layer 1 made of such a plastic film may be subjected to etching treatment or priming treatment such as sputtering, corona discharge, flame treatment, ultraviolet ray irradiation, electron beam irradiation, conversion treatment, or oxidation in advance to improve an adhesive nature to the base layer of the dielectric thin film provided on the transparent base layer 1. Before providing the dielectric thin film, dust removal and cleaning may be performed by solvent cleaning, ultrasonic cleaning, or the like as required.

The conductive thin film 4 (4*a*) is formed on one surface of such a transparent base layer 1. As a base for the conductive thin film 4 (4*a*), a transparent dielectric thin film 2 and a transparent second dielectric thin film 3 are stacked in this order. These dielectric thin films 2 and 3 do not have to be provided depending on a case. However, it is possible to further improve durability against an end push input pen by providing the dielectric thin films 2 and 3.

Examples of a material of the first and the second dielectric thin films include inorganic substances such as NaF, $Na_3AlF_6$, LiF, $MgF_2$, $CaF_2$, $BaF_2$, $SiO_2$, $LaF_3$, $CeF_3$, and $Al_2O_3$, organic substances such as acrylic resin, urethane resin, melamine resin, alkyd resin, and siloxane polymer, and mixtures of these inorganic substances and the organic substances.

Among these materials, the organic substances or the mixtures of the organic substances and the inorganic substances are preferable for a material of the first dielectric thin film. In particular, thermoplastic resin made of melamine resin, alkyd resin, and organic silane condensate is preferably used. In addition, the inorganic substances or the mixtures of the organic substances and the inorganic substances are preferable for a material of the second dielectric thin film. In particular, $SiO_2$, $MgF_2$, $Al_2O_3$, and the like are used preferably.

It is possible to form the first and the second dielectric thin films by the vacuum evaporation method, the sputtering method, the ion plating method, the coating method, and the like using the materials described above.

It is preferable that the first dielectric thin film has thickness of 100 to 250 nm, more preferably 130 to 200 nm. It is preferable that the second dielectric thin film has thickness of 15 to 100 nm, preferably 20 to 60 nm.

With the first dielectric thin film 2 and the second dielectric thin film 3 as a base, the transparent conductive thin film 4 (4*a*) is provided thereon.

It is possible to form this conductive thin film in the same method as the case of the base thin film described above. A thin film material to be used is not specifically limited. For example, indium oxide containing tin oxide, tin oxide containing antimony, and the like are used preferably.

It is preferable that the conductive thin film usually has thickness of 10 nm or more, preferably 10 to 300 nm. When the thickness is less than 10 nm, the conductive thin film hardly becomes a continuous coating having satisfactory electric conductivity with a surface resistivity of $10^3$ Ω/□ or less. When the thickness is too large, decline in transparency tends to be caused.

The transparent base layer 6 made of another plastic film is stuck to the other surface of the transparent base layer 1, on which the transparent conductive thin film 4 (4*a*) is formed via the base thin film in this way, via the transparent adhesive layer 5.

It is possible that the adhesive layer 5 is provided on the base layer 6 and the base layer 1 is stuck to the adhesive layer 5 or, conversely, the adhesive layer 5 is provided on the base layer 1 and the base layer 6 is stuck to the adhesive layer 5. The base layer 1 is usually designed thin compared with the base layer 6. Thus, in the latter method, it is possible to continuously form the adhesive layer 5 by forming the base layer 1 in a roll shape, which is advantageous in terms of productivity.

The adhesive layer 5 only has to have transparency. For example, acrylic adhesive, silicone adhesive, rubber adhesive, and the like are used. The adhesive layer 5 improves properties such as frictioning resistance and flex resistance of the conductive thin film 4*a* provided on one surface of the base layer 1 according to the cushion effect of the base layer 6 after the base layer 6 is stuck. In order to show this function better, it is preferable to set an elastic coefficient of the adhesive layer 5 in a range of $1\times10^5$ to $1\times10^7$ dyn/cm$^2$ and set thickness thereof to 1 μm or more, more preferably in a range of 5 to 100 μm.

When the elastic coefficient of the adhesive layer 5 is less than $1\times10^5$ dyn/cm$^2$, since the adhesive layer changes to non-elastic, the adhesive layer 5 is easily deformed by pressure to cause unevenness on the base layer 1 and the conductive thin film 4*a*. In addition, the adhesive tends to be pushed out from a machine-cut surface and the effect of improvement of frictioning resistance, flex resistance, and the like of the conductive thin film 4*a* is reduced. In addition, when the elastic coefficient exceeds $1\times10^7$ dyn/cm$^2$, the adhesive layer hardens, the cushion effect thereof cannot be expected, and the properties such as frictioning resistance and flex resistance cannot be improved.

When the thickness of the adhesive layer 5 is less than 1 μm, since the cushion effect thereof cannot be expected, it is difficult to improve the properties such as frictioning resistance and flex resistance of the conductive thin film 4*a*. In addition, when the adhesive layer is made too thick, transparency is damaged and it is difficult to obtain satisfactory results in terms of formation of the adhesive layer, the sticking workability for the base layer 6, and cost.

The base layer 6 stuck to the transparent base layer 1 via such an adhesive layer 5 gives satisfactory mechanical strength to the base layer 1 and, in particular, contributes to prevention of occurrence of curl or the like. Therefore, usually, a plastic film with thickness of about, for example, 6 to 300 μm, which is thicker than the base layer 1, is preferably used as the base layer 6. Examples of a material of the plastic film include the same material as that of the base layer 1.

The hard coast treatment layer 7 is formed on the uppermost surface on the pen input side of the base layer 6 in order to improve frictioning resistance and the like against pen input. As the hard coast treatment layer 7, for example, a cured coasting made of cured resin such as melanin resin, urethane resin, alkyd resin, acrylic resin, and silicon resin is preferably used. For the purpose of improvement of visual recognition, other surface treatment layers such as a glare-preventing treatment layer and a reflection prevention layer may be formed together with the hard coat treatment layer or instead of the hard coast treatment layer 7.

In the touch panel shown in FIG. 1, the lower panel board P2 has the conductive thin film 4*b* formed on one surface of the base layer 11 made of a transparent glass board. It is possible to form the conductive thin film 4*b* with the same method using the same material as the conductive thin film 4*a* in the upper panel board P1.

In the touch panel shown in FIG. 2, the lower panel board P3 has the conductive thin film 4*c* formed on one surface of the transparent base layer 12 made of a plastic film. A film with the same material and the same thickness as the base layer 6 forming the upper panel board P1 in FIG. 1 is used for the base layer 12. It is possible to form the conductive thin film 4*c* with the same method using the same material as the conductive thin film 4*a* in the upper panel board P1.

The lower panel board P3 is stuck to the glass board 14 of the display device such as a liquid crystal cell via the transparent adhesive layer 13. An adhesive layer with the same material as the adhesive layer 5 forming the upper panel board P1 in FIG. 1 is used as the adhesive layer 13.

In the invention, it is possible to provide a image display device having above mentioned touch pane disposed on a visual side of the display device. For example, in the touch panel shown in FIG. 2, the glass plate 14 constitute a visual side of the display device, and the image display device having the constitution that the touch panel is directly disposed on the display device via a adhesive layer 13 can be provided. Furthermore, in the touch panel shown in FIG. 1, the image display device having the constitution that the lower panel board P2 side of the touch panel is disposed on the visual side of the display device by an adequate method.

EXAMPLES

The present invention is now illustrated in greater detail with reference to Examples and Comparative Examples, but it should be understood that the present invention is not to be construed as being limited thereto.

Hereinafter, "part" and "%" means "parts by weight" and "% by weight", respectively. A refractive index of light is a value measured by an Abbe refractometer.

Example 1

Production of a Transparent Conductive Film

A transparent first dielectric thin film with thickness of 150 nm was formed on one surface of a base layer made of a polyethylene terephthalate film (hereinafter referred to as a PET film) with thickness of 25 μm using thermosetting resin (with refractive index of light of 1.54) made of a mixture of melamine resin, alkyd resin, and organic silane condensate with a weight ratio of 2:2:1.

Next, silica sol ("Colcoat" manufactured by Colcoat Co., Ltd.) was diluted with ethanol to have a solid concentration of 2%, applied on the first dielectric thin film and dried and cured at 150° C. for two minutes to form a transparent second dielectric thin film made of an $SiO_2$ thin film (with a refractive index of light of 1.46) with thickness of about 30 nm.

Then, a transparent conductive thin film (hereinafter referred to as ITO thin film) with thickness of 20 nm made of a composite oxide of indium oxide and tin oxide (with a refractive index of light of 2.00) was formed on the second dielectric thin film by the reactive sputtering method using an alloy of indium 97% and tin 3% in the atmosphere of $4\times10^{-3}$ Torr containing an argon gas 80% and oxygen gas 20%. Consequently, a transparent conductive film was manufactured.

Production of a Hard Coat Treatment Film 5 parts of hydroxyl-cyclohexyl-phenylketone ("Irgacure 184" manufactured by Chiba Specialty Chemicals) as a photo-polymerization initiator was added to 100 parts of acrylic urethane resin ("Unidic 17-806) manufactured by Dainippon Ink and Chemicals, Incorporated), toluene solution diluted to a concentration of 50% was applied and dried at 100° C. for three minutes, and then, ultraviolet rays were irradiated immediately with two ozone-type high-pressure mercury lamps (80 W/cm, 15 cm condensing type) to form a hard coast treatment layer with thickness of 5 μm on an entire surface of a base layer made of a PET film with thickness of 125 μm. Consequently, a hard coat treatment film was manufactured.

Production of a Transparent Conductive Laminated Film

An acrylic transparent adhesive layer (with one part of an isocyanate crosslinking agent compounded in 100 parts of an acrylic copolymer having a weight ratio of butyl acrylate, acryl acid, and vinyl acetate of 100:2:5) with an elastic coefficient adjusted to $1\times10^6$ dyn/cm$^2$ was formed at thickness of about 20 μm on the other surface of the base layer forming the transparent conductive film. A transparent conductive laminated film was manufactured on the adhesive layer by sticking the hard coat treatment film on an opposite surface side of the hard coast treatment layer of the base layer.

Production of a Touch Panel with a film/glass constitution

The transparent conductive laminated film was used as an upper panel board on the pen input side. A panel board having an ITO thin film with thickness of 30 nm formed on a glass board in the same method as described above was used as a lower panel board. Both the panel boards were arranged to be opposed to each other via a spacer with thickness of 10 μm such that the ITO thin films were opposed to each other and a distance between the ITO thin films was 60 μm as a gap between both the panel boards.

Figure 3:
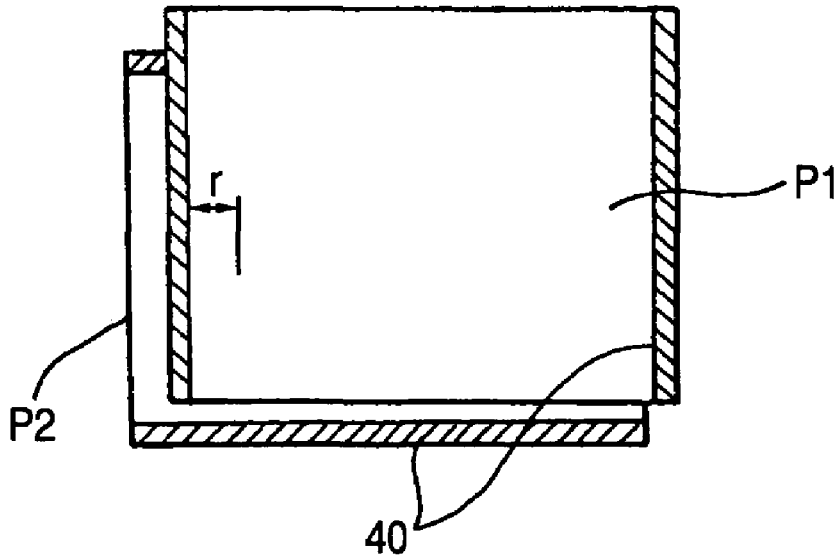
FIG. 3 is a diagram showing that silver electrodes are formed at ends of upper and lower panel boards and is a diagram for explaining a position to measure a durability against end push pen input (a position from the silver electrodes: distance r).

Note that the respective ITO thin films of both the panel boards were formed to be orthogonal to each other in advance before arranging both the panel boards to be opposed to each other. In addition, as shown in FIG. 3, silver electrodes 40 were formed at both ends of both panel boards P1 and P2 to use the silver electrodes 40 as terminals for voltage measurement.

Example 2

A touch panel was manufactured in the same manner as Example 1 except that a distance between ITO thin films was set to 30 μm as a gap between both panel boards.

Example 3

A touch panel was manufactured in the same manner as Example 1 except that a distance between ITO thin films was set to 100 μm as a gap between both panel boards.

Comparative Example 1

A touch panel was manufactured in the same manner as Example 1 except that a distance between ITO thin films was set to 120 μm as a gap between both panel boards.

Comparative Example 2

A touch panel was manufactured in the same manner as Example 1 except that a panel board having an ITO thin film with thickness of 30 nm formed on one surface of a PET film with thickness of 125 μm and a hard coat treatment layer with thickness of 5 μm formed on the other surface on the pen input side was used as an upper panel board on the pen input side instead of the transparent conductive laminated film in Example 1.

Figure 4:
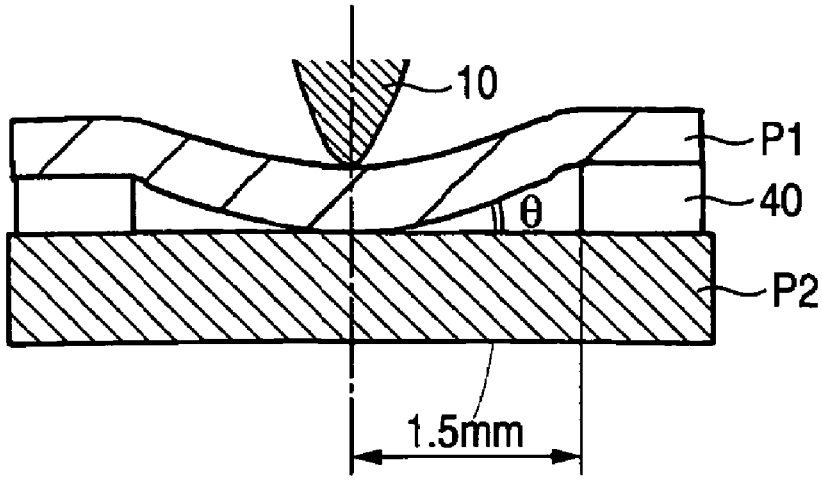
FIG. 4 is a diagram for explaining a pushing angle θ at a point distant from a silver electrode provided at an end portion of the panel board by 1.5 mm (r=1.5 mm).

In the respective touch panels in Examples 1 to 3 and Comparative Examples 1 and 2, as shown in FIG. 4, a pushing angle θ at the time when an input pen 10 was pressed against the lower panel board P2 from the upper panel board P1 side at a point 1.5 mm from the silver electrode 40 (at a point of r=1.5 mm in FIG. 3) was measured. In addition, durability against end push pen input was measured with a method described below.

Results of the measurements were as shown in Table 1. Note that, in Table 1, the distance d between the ITO thin films is also written as a gap between the upper and the lower panel boards.

Durability Against End Push Pen Input

A pen made of polyacetal (with a pen tip R of 0.8 mm) was slid 100 thousand times with a load of 250 g from the upper panel board side. A position from the end of the panel board where linearity after the sliding was 1.5% or less was measured as a distance r from the silver electrode 40 of the upper panel P1 shown in FIG. 3. As the distance r is smaller, the touch panel is more excellent in durability against end push pen input. Note that the linearity was measured as described below.

Measurement Method for Linearity

A voltage of 5 V is applied to the ITO thin films of the touch panel to measure an output voltage between a terminal A (a measurement starting position) and a terminal B (a measurement ending position) to which the voltage is applied.

When an output voltage in the measurement starting position A is set as $E_A$, an output voltage in the measurement ending position B is set as $E_B$, an output voltage at respective measurement points X is set as $E_X$, and a logical value is set as $E_{XX}$, linearity can be calculated according to the following calculation.

$$E_{xx} \text{ (theoretical value)} = X \cdot (E_B - E_A)/(B - A) + E_A$$

$$\text{Linearity (\%)} = [(E_{XX} - E_X)/(E_B - E_A)] \times 100$$

Figure 5:
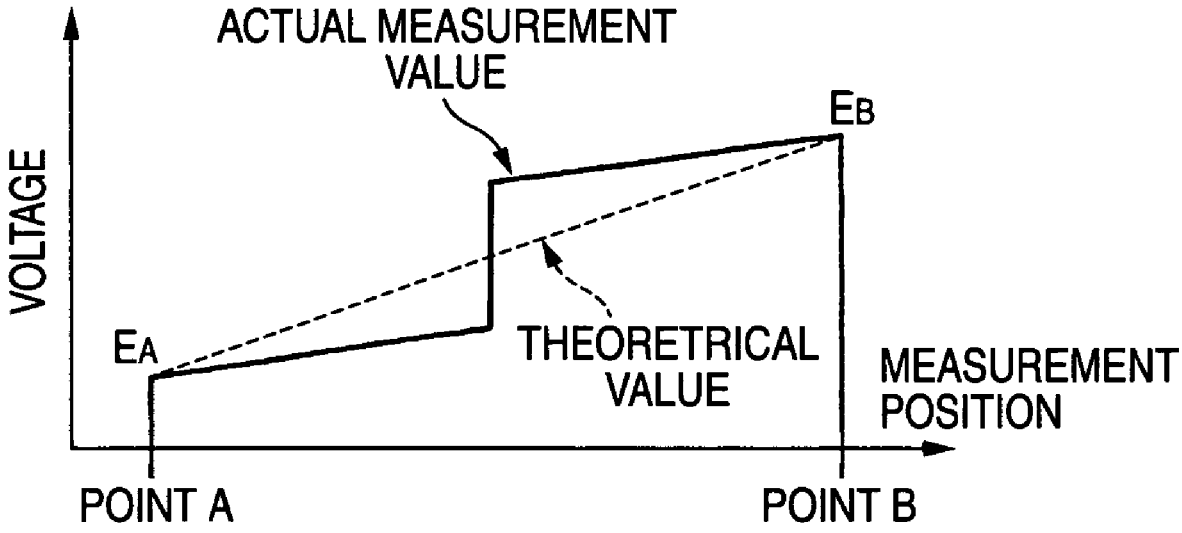
FIG. 5 is a diagram for explaining an outline of linearity measurement.

An outline of the linearity measurement is as shown in FIG. 5.

In an image display using the touch panel, as the touch panel is pressed by the input pen, a position of a pen displayed on a screen is determined from a resistance value in a contact part of the upper panel board and the lower panel board. The resistance value is determined assuming that an output voltage distribution on surfaces of the upper and the lower panel boards is as indicated by a logical line (an ideal line).

Then, when a voltage value deviates from the logical line as indicated by an actual measurement value in FIG. 5, an actual pen position and the pen position on the screen determined by the resistance value do not synchronize well. The deviation from the logical line is linearity. As a value of the linearity is smaller, a gap between the actual pen position and the pen position on the screen is smaller. Thus, when the linearity is equal to or smaller than 1.5%, the linearity is judged satisfactory and the position (a distance from the end) is measured.

TABLE 1

| | Distance d between ITO thin films (μm) | Pushing Angle θ by input pen at point of r = 1.5 mm (degrees) | Durability against end push pen input (Position from silver electrode: distance r) (mm) |
|---|---|---|---|
| Example 1 | 60 | 2.3 | 1.1 |
| Example 2 | 30 | 1.1 | 0.6 |
| Example 3 | 100 | 3.8 | 1.5 |
| Comparative Example 1 | 120 | 4.6 | 1.9 |
| Comparative Example 2 | 60 | 2.3 | 5.0 |

As it is evident from Table 1, in the respective touch panels in Examples 1 to 3, the distance between the ITO thin films is set to 30 to 100 μm as a gap between both the panels such that the pushing angle θ at a point r=1.5 mm from the silver electrode provided at the ends of the panels is 3.9° or less. Consequently, compared with the touch panels in Comparative Examples 1 and 2 that do not adopt the constitution of the invention, the touch panels are excellent in durability against end push pen input and it is possible to control rim edge areas of the touch panels to 1.5 mm or less.

Example 4

Production of a Touch Panel with a film/film constitution

The transparent conductive laminated film manufactured in Example 1 was used as an upper panel board on the pen input side. A panel board having an ITO thin film with thickness of 30 nm formed on a base layer, which was made of a PET film with thickness of 125 μm, in the same method as Example 1 was used as a lower panel board. Both the panel boards were arranged to be opposed to each other via a spacer with thickness of 10 μm such that the ITO thin films were opposed to each other and a distance between the ITO thin films was 60 μm as a gap between both the panel boards.

Next, an acrylic transparent adhesive layer (with one part of an isocyanate crosslinking agent compounded in 100 parts of an acrylic copolymer having a weight ratio of butyl acrylate, acryl acid, and vinyl acetate of 100:2:5) with an elastic coefficient adjusted to $1\times10^6$ dyn/cm$^2$ was formed at thickness of about 20 μm on a surface side opposite to the ITO thin film formed surface of the lower panel board in this touch panel. The touch panel was stuck onto a glass board of a liquid crystal display via this adhesive layer, whereby a touch panel integrated display shown in FIG. 2 was manufactured.

Example 5

A touch panel integrated display was manufactured in the same manner as Example 4 except that a distance between ITO thin films was set to 30 μm as a gap between both panel boards.

Example 6

A touch panel integrated display was manufactured in the same manner as Example 4 except that a distance between ITO thin films was set to 80 μm as a gap between both panel boards.

Example 7

A touch panel integrated display was manufactured in the same manner as Example 4 except that a distance between ITO thin films was set to 30 μm as a gap between both panel boards and thickness of an adhesive layer for sticking the touch panel to a liquid crystal display was set to 10 μm.

Comparative Example 3

A touch panel integrated display was manufactured in the same manner as Example 4 except that a distance between ITO thin films was set to 120 μm as a gap between both panel boards.

Comparative Example 4

A touch panel integrated display was manufactured in the same manner as Comparative Example 3 except that a thickness of an adhesive layer for sticking the touch panel to a liquid crystal display was set to 40 μm.

Comparative Example 5

A touch panel integrated display was manufactured in the same manner as Comparative Example 3 except that a panel board having an ITO thin film with thickness of 30 nm formed on one surface of a PET film with thickness of 125 μm and a hard coat treatment layer with thickness of 5 μm formed on the other surface on the pen input side was used as an upper panel board on the pen input side instead of the transparent conductive laminated film in Example 1.

In the respective touch panel integrated displays in Examples 4 to 7 and Comparative Examples 3 to 5, in the same manner as the above description, a pushing angle θ at the time when an input pen was pressed against the lower panel board from the upper panel board side at a point 1.5 mm from the silver electrode 40 (see FIG. 4) was measured. In addition, durability against end push pen input was measured in the same manner as the above description.

Results of the measurements were as shown in Table 2. Note that, in Table 2, the distance d between the ITO thin films as a gap between the upper and the lower panel boards and thickness t of the adhesive layer for attaching the lower panel board to the liquid crystal display were also written.

TABLE 2

| | Distance d between ITO thin films (μm) | Thickness t of the adhesive layer (μm) | Pushing Angle θ by input pen at point of r = 1.5 mm (degrees) | Durability against end push pen input (Position from silver electrode: distance r) (mm) |
|---|---|---|---|---|
| Example 4 | 60 | 20 | 3.1 | 1.2 |
| Example 5 | 30 | 20 | 1.9 | 0.9 |
| Example 6 | 80 | 20 | 3.8 | 1.6 |
| Example 7 | 30 | 10 | 1.5 | 0.7 |
| Comparative Example 3 | 120 | 20 | 5.4 | 2.3 |
| Comparative Example 4 | 120 | 40 | 6.1 | 2.5 |
| Comparative Example 5 | 120 | 20 | 5.4 | 4.0 |

As it is evident from Table 2, in the respective touch panel integrated displays in Examples 4 to 7, the distance between the ITO thin films is set to 30 to 80 μm as a gap between both the panels and the thickness of the adhesive layer for sticking the touch panel to the liquid crystal display is set to 10 to 20 μm such that the pushing angle θ by the input pen at a point r=1.5 mm from the silver electrode is 3.9° or less. Consequently, compared with the touch panel integrated displays in Comparative Examples 3 to 5 that do not adopt the constitution of the invention, the touch panel integrated displays are excellent in durability against end push pen input and it is possible to control rim edge areas of the touch panels to 1.6 mm or less.

In this way, the invention provides a touch panel using a panel board having a plastic film as a base layer in which a gap between upper and lower panel boards is reduced, a distance between conductive films is set in a specific range, and a base layer made of a plastic film is also used in the lower panel board. In the touch panel, the gap is reduced and thickness of an adhesive layer for sticking the lower panel board to a glass board of a display device is set in a specific range such that an pushing angle by an input pen at a point 1.5 mm from electrodes provided at ends of the panel boards is equal to or smaller than a fixed value. Thus, it is possible to obtain an improved durability against an end push input pen that can meet a requirement of a narrow rim end.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2004-162724 filed on Jun. 1, 2004 and No. 2005-083642 filed on Mar. 23, 2005, and the contents thereof are incorporated herein by reference.

What is claimed is:

1. A touch panel comprising:

a first panel board having a first base layer and a first conductive thin film disposed on one side of the first base layer;

a second panel board having a second base layer and a second conductive thin film disposed on one side of the second base layer;

a second adhesive layer; and a third base layer comprising a plastic film, wherein the first panel board and the second panel board are arranged through a spacer so that the first conductive thin film and the second conductive thin film face each other, wherein the distance between the first conductive thin film and the second conductive thin film is from 20 to 100 μm, wherein the touch panel has a pushing angle of 3.9° or less at a point distant from an electrode provided at an end portion of the first panel board by 1.5 mm, wherein the first base layer has a thickness of 2 to 120 μm, wherein the third base layer is disposed on the other side of the first base layer, which is opposite to the side on which the first conductive thin film is disposed, through the second adhesive layer, wherein said first base layer is the pen-input side base layer.

2. The touch panel according to claim 1, wherein the first base layer comprises a plastic film, and the second base layer comprises a glass layer.

3. The touch panel according to claim 1, which further comprises a first adhesive layer having a thickness of from 2 to 30 μm so that the second panel board is disposed on a glass plate of an image display device through the first adhesive layer, wherein the first base layer comprises a plastic film, and the second base layer comprises a plastic film.

4. An image display device comprising:

a display device; and a touch panel according to claim 1 disposed on a visual side of the display device.

* * * * *